United States Patent [19]

Jerman

[11] 4,249,548

[45] Feb. 10, 1981

[54] COMBINATION SUN VISOR AND HAIR PICK

[76] Inventor: Rafael Jerman, 6850 W. 14th Ct. Apt. 25-C, Hialeah, Fla. 33014

[21] Appl. No.: 39,511

[22] Filed: May 16, 1979

[51] Int. Cl.[3] ..... A45D 1/00

[52] U.S. Cl. ..... 132/9

[58] Field of Search ..... 132/9, 11 R, 144, 106

[56] References Cited

U.S. PATENT DOCUMENTS

| | | | |
|---|---|---|---|
| 225,247 | 3/1880 | Tillinghast | 132/11 R |
| 896,373 | 8/1908 | Fréchette | 132/144 |
| 950,963 | 3/1910 | Shearer | 132/144 |
| 3,283,344 | 11/1966 | Blanchard | 132/9 UX |
| 3,424,174 | 1/1969 | Battaglia | 132/11 R |

*Primary Examiner*—G. E. McNeill

*Attorney, Agent, or Firm*—Ernest H. Schmidt

[57] ABSTRACT

A combination sun visor and hair pick has a substantially rigid visor body portion contoured to fit close to the forehead of the wearer, and a plurality of pick members extending outwardly of the rear edge of the visor for dual use as means for attachment of the visor with respect to a so-called "Afro" hair style, and for use as a hair pick using the visor as a manipulating handle.

3 Claims, 3 Drawing Figures

COMBINATION SUN VISOR AND HAIR PICK

Sun visors heretofore known are either provided as part of a head cap or equipped with a head strap of one kind or another for supporting them in place against the forehead of the user. When worn with a bouffant hair style such as the so-called "Afro" hair-do, visor caps and supporting straps are unsuitable for the reason that their use compresses various portions of the hair shape, thereby leaving unsightly indentations upon removal of the visor. It is, accordingly, the principal object of this invention to provide a novel and improved sun visor for "Afro" style hair-dos that obviates the deficiencies of visors heretofore known.

A more particular object of the invention is to provide a combination sun visor and hair pick wherein the means for attachment of the visor with respect to the head of the user comprises a plurality of elongated pick members extending outwardly of the inner edge of the visor body and adapted to be received in frictional interengagement with the hair above the scalp for retention in adjusted position.

Yet another object is to provide a combination sun visor and hair pick of the character above described wherein the supporting picks are of serpentine configuration along central portions of their lengths, for frictional interengagement with the hair, and comparatively straight at their outer ends for alternative use as a hair pick when not being used as a sun visor.

Yet another object of the invention is to provide a combination sun visor and hair pick wherein the visor body portion is fabricated of a substantially rigid synthetic plastic material, and the pick members are fabricated of spring wire the inner end portions of which are embedded within a rear edge portion of the body member, whereby the visor body can serve as a manipulating handle upon use of the assemblage as a hair pick.

Yet another object is to provide a combination sun visor and hair pick of the above nature which will be simple in construction, economical to manufacture, attractive in appearance and durable in use.

Other objects, features and advantages of the invention will be apparent from the following description when read with reference to the accompanying drawings. In the drawings, wherein like reference numerals denote corresponding parts throughout the several views.

Figure 2:
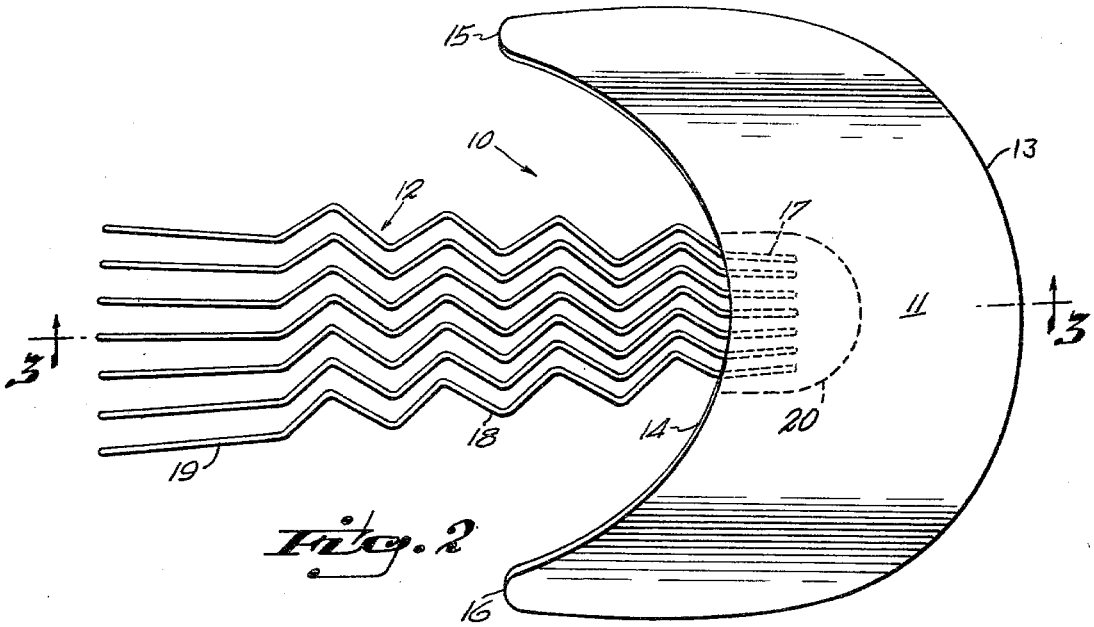
FIG. 2 is a top view of the combination sun visor and hair pick, shown separately.

Referring now in detail to the drawings, reference numeral 10 designates a preferred form of a combination sun visor and hair pick embodying the invention, the same comprising, generally, a visor body member 11 and a plurality of pick members 12 extending outwardly thereof. The visor body member 11 is substantially rigid, and preferably will be integrally formed of a synthetic plastic material by injection molding. As best illustrated in FIG. 2, the visor body member 11 is symmetrically formed in arcuate shape from side to side and has a convexly-arcuate front edge portion 13 and a concavely-arcuate rear edge portion 14, the ends of said concavely-arcuate rear edge portion merging with the ends of said convexly-arcuate front edge portion at opposed reversely- rounded edge portions 15, 16.

Figure 3:
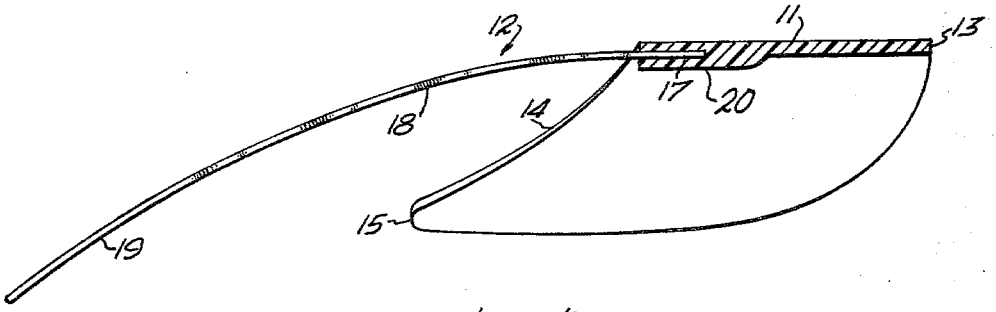
FIG. 3 is a longitudinal cross-sectional view of the combination sun visor and hair pick, taken along the line 3—3 of FIG. 2 in the direction of the arrows.

The pick members 12 will preferably be formed of heavy gauge steel or stainless steel spring wire, each having a straight inner end portion 17, a serpentine central portion 18 and an outer, comparatively-straight portion 19 of substantially greater length than the length of inner end portion 17. Additionally, each pick member 12 is also bent into shallow arcuate form from end to end, as best illustrated in FIG. 3. As illustrated in FIGS. 2 and 3, the inner end portions 17 are attached to and extend outwardly of the concavely-arcuate rear edge portion 14 of visor body member 11, being uniformly spaced along the central portion thereof. To this end the visor body member 11, which will preferably be of substantially uniform thickness may be provided with a zone of increased thickness 20 for reinforcement of the area of embedment of the pick members. In this connection it is to be understood that embedment of the pick members in the visor body member 11 will preferably be effected during the molding process.

Figure 1:
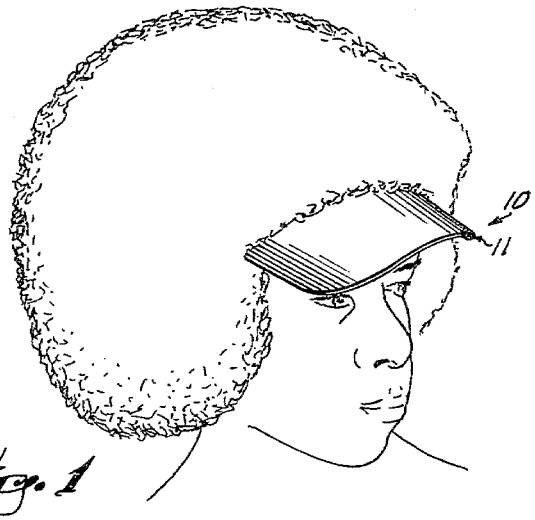
FIG. 1 illustrates the combination sun visor and hair pick in use as a sun visor.

In use as a sun visor, the serpentine pick members 12 are simply pushed into the hair near the scalp adjacent the forehead, as illustrated in FIG. 1. The serpentine central portions 18 of the pick members interengage with the compacted curly mass of the so-called "Afro hair-do" to retain the visor in its adjusted position.

A salient feature of the invention resides in the fact that the usual means for supporting a sun visor, such as an integral hat, or a band or strap fitted around the back of the head, is entirely eliminated, thereby also eliminating the unsightly indentations or depressions in the external shape of the hair-do which would otherwise occur. When not being used as a sun visor, the outer straight portions 19 of the pick members 12 serve as a hair pick, with the visor body member being used as a pick manipulating handle.

What I claim as new and desire to secure by Letters Patent is:

1. A combination sun visor and hair pick comprising, in combination, a substantially rigid visor body member, said visor body member having a front edge portion of convexly arcuate shape and a concavely-arcuate rear edge portion, said visor body member further being of arcuate shape from side-to-side, a plurality of elongated spring wire pick members extending outwardly of a central zone along said concavely-arcuate rear edge portion of said body member and in mutually spaced relation therealong, said pick members having serpentine configurated central portion along their lengths for frictional retainment in an "Afro hair-do", said pick members having straight outer end portions suited to use as a hair pick upon using said visor body member as a manipulating handle, the ends of said concavely-arcuate rear edge portion of said visor body member merging with the ends of said convexly-arcuate front edge portion of said visor body member at opposed, reversely-rounded merging edge portions, said pick members being downwardly curved in the direction of said reversely-rounded merging edge portions.

2. A combination sun visor and hair pick as defined in claim 1 wherein said visor body member is fabricated of synthetic plastic material, inner end portions of said pick members being embedded in said synthetic plastic material.

3. A combination sun visor and hair pick as defined in claim 2 wherein the zone of embedment of said pick members is of increased thickness with respect to the remainder of said visor body member, said remainder of said visor body member being of substantially uniform thickness.

* * * * *